US006316757B1

(12) United States Patent
Kim et al.

(10) Patent No.: US 6,316,757 B1
(45) Date of Patent: Nov. 13, 2001

(54) HALOGEN HEATER CONTROL APPARATUS OF MICROWAVE OVEN AND METHOD THEREOF

(75) Inventors: Yang Kyeong Kim, Inchon; Jong Gwan Ryu; Sung Jin Han, both of Seoul; Wan Soo Kim, Kwangmyung, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/688,849

(22) Filed: Oct. 17, 2000

(30) Foreign Application Priority Data

Mar. 23, 2000 (KR) ..... 00/14793

(51) Int. Cl.[7] ..... H05B 6/68; H05B 6/80

(52) U.S. Cl. ..... 219/680; 219/685; 219/702; 219/718; 219/482; 392/407; 99/325

(58) Field of Search ..... 219/680, 685, 219/715, 716, 702, 719, 718, 482, 492; 99/325, DIG. 14, 451; 392/407, 416, 440

(56) References Cited

U.S. PATENT DOCUMENTS 4,771,154 * 9/1988 Bell et al. ..... 219/685
5,517,005 * 5/1996 Westerberg et al. ..... 219/685

FOREIGN PATENT DOCUMENTS 2 170 665 * 8/1986 (GB) .
9-219278 * 8/1997 (JP) .
11-351576 * 12/1999 (JP) .
WO 00/42823 * 7/2000 (WO) .

* cited by examiner

*Primary Examiner*—Philip H. Leung
(74) *Attorney, Agent, or Firm*—Birch, Stewart, Kolasch & Birch, LLP

(57) ABSTRACT

A halogen heater control apparatus of a microwave oven and a method thereof, comprises a plurality of halogen heaters which are connected to a utility AC power source, and a halogen heater switching unit. The halogen heater and incrementally alters infrared wavelengths from the halogen heater, and a microcomputer controls the operation of the halogen heater switching unit. The present invention is capable of optimum foodstuff heating and cooking by incrementally altering and controlling the infrared wavelengths from the halogen heater by controlling the utility AC power source duty cycle to the halogen heater in accordance with control signals generated by the microcomputer.

13 Claims, 4 Drawing Sheets

HALOGEN HEATER CONTROL APPARATUS OF MICROWAVE OVEN AND METHOD THEREOF

BACKGROUND OF THE INVENTION

1. Field of the Invention

The present invention relates to a halogen heater control apparatus of a microwave oven and a method thereof, and in particular to the halogen heater control apparatus of the microwave oven and the method thereof which is capable of optimum heating and cooking foodstuff by altering in increments the infrared wavelengths from a halogen heater for controlling the phase of a utility AC power source to the halogen heater.

2. Description of the Prior Art

In general, the conventional microwave oven heats and cooks foodstuff by using microwaves. The conventional microwave oven comprises a high voltage transformer and a magnetron. When AC power is applied to the high voltage transformer, the high voltage which operates the magnetron is generated, and the magnetron generates high frequency microwaves into the sealed space storing the foodstuff.

The outputted microwaves vibrate $H_2$ molecules of the foodstuff, the vibrations of the $H_2$ molecules generate frictional heat, and the foodstuff is cooked by the frictional heat of the molecules.

Meanwhile, the conventional magnetron microwave oven heats and cooks the foodstuff by using only the microwaves generated from the magnetron, but the latest microwave oven comprises a magnetron and a halogen heater, accordingly it can heat and cook the foodstuff by using infrared wavelengths generated from the halogen heater in addition to the microwaves.

FIG. 1 is a schematic front view of the conventional microwave oven. FIG. 2 is a circuit diagram illustrating the conventional halogen heater control apparatus of the microwave oven comprising a microcomputer 70 which outputs a control signal corresponding to a key input of a user. A first, a second and a third relay 10-1, 10-2, 10-3 provide and cut off utility AC power source (AC: 120 V/60 HZ) to a first, a second and a third halogen heaters H1, H2, H3 in accordance with the control signal of the microcomputer 70. The first, second, and third halogen heaters H1, H2, H3 separately output the infrared wavelengths in accordance with an ON/OFF operation of the first, second and third relays 10-1, 10-2, 10-3.

The operation of the conventional halogen heater control apparatus of the microwave oven will now be described. When a magnetron output mode is selected as a microwave oven output mode by a user, the magnetron operates by the high voltage generated from the high voltage transformer (not shown), and the foodstuff is heated and cooked by the microwave outputted from the magnetron.

Meanwhile, when a halogen heater output mode is selected as a microwave oven output mode by the user, the foodstuff is heated and cooked by the infrared outputted from the halogen heaters H1, H2, H3. This will be described with the first halogen heater H1 as an example.

First, the microcomputer 70 outputs the control signal in accordance with kind of foodstuff, the first relay 10-1 is ON according to the control signal and applies the utility AC power source to the first halogen heater H1, and the halogen heater H1 outputs the infrared radiation. Accordingly, the foodstuff is heated and cooked by the infrared radiation. The infrared wave output process of the second and third halogen heaters H2, H3 are the same as with the infrared wave output process of the first halogen heater H1.

However, since the infrared waves from the halogen heaters operate in accordance with the ON/OFF operation of the relays, it only has two kinds of operation such as ON/OFF. Accordingly, it cannot heat and cook the foodstuff efficiently. When the electricity inputted to the halogen heater is provided after being cut off, the heating and cooking times required are longer, and mechanical trouble frequency may increase due to the consecutive ON/OFF operation of the halogen heaters.

SUMMARY OF THE INVENTION

It is an object of the present invention to provide a halogen heater control apparatus of a microwave oven and a method thereof which is capable of controlling the phase of the utility AC power source inputted to the halogen heaters, altering infrared wavelengths outputted from the halogen heaters, in order to provide optimum foodstuff heating and cooking.

To achieve this and other objects, the preferred embodiment of the present invention comprises a halogen heater unit which is connected to a utility AC power source, a halogen heater switching unit connected to the utility AC power source and to the halogen heater unit, which alters and controls the infrared wavelengths outputted from the halogen heaters, and a microcomputer which controls the halogen heater switching unit to selectively control the wavelength's output.

In order to cook the foodstuff, the preferred embodiment of the method of the present invention comprises a process which judges whether the selected mode by the user is the halogen heater output mode, recognizes a cooking time and a kind of dish or foodstuff when the halogen output mode is confirmed as the selected mode, alters the infrared wavelength outputted from the halogen heaters according to the recognition result, and cooks the foodstuff.

DETAILED DESCRIPTION OF THE PREFERRED EMBODIMENT

A halogen heater control apparatus of a microwave oven and a method thereof of the present invention will now be described in detail with reference to the accompanying drawings.

Figure 1:
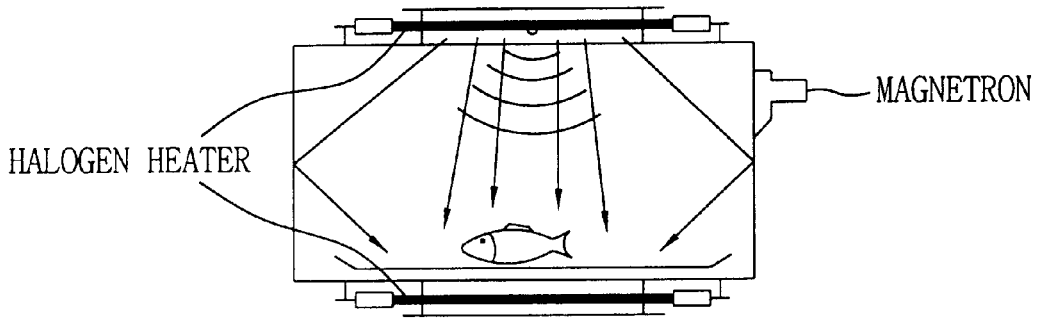
FIG. 1 CONVENTIONAL ART
FIG. 1 is a schematic front view illustrating the conventional halogen heater/microwave oven.
Figure 2:
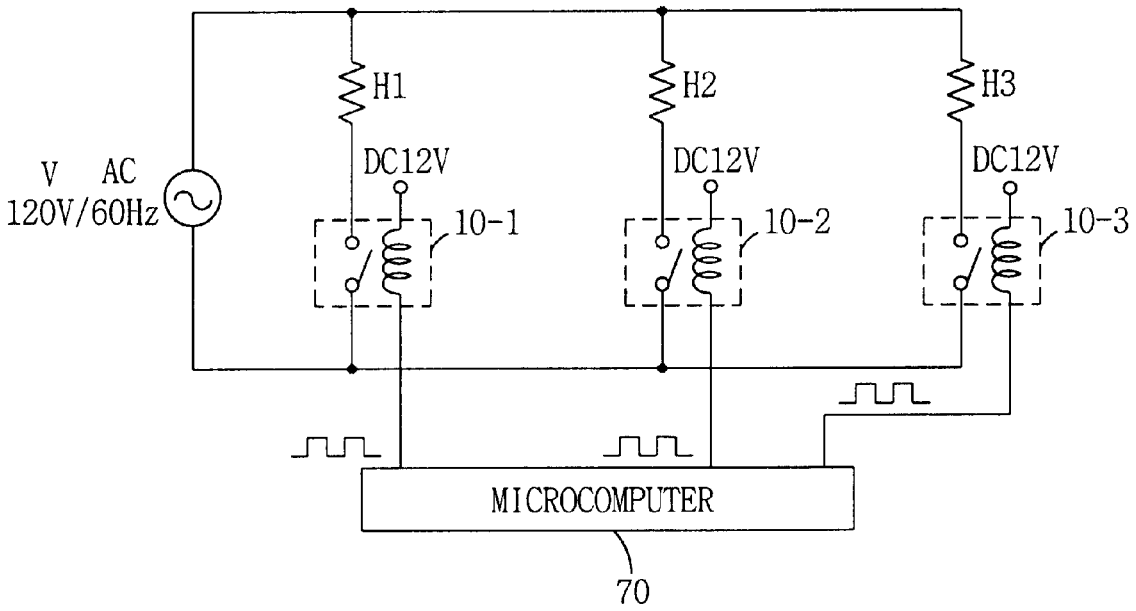
FIG. 2 CONVENTIONAL ART
FIG. 2 is a circuit diagram of the conventional halogen heater control apparatus of the microwave oven.
Figure 3:
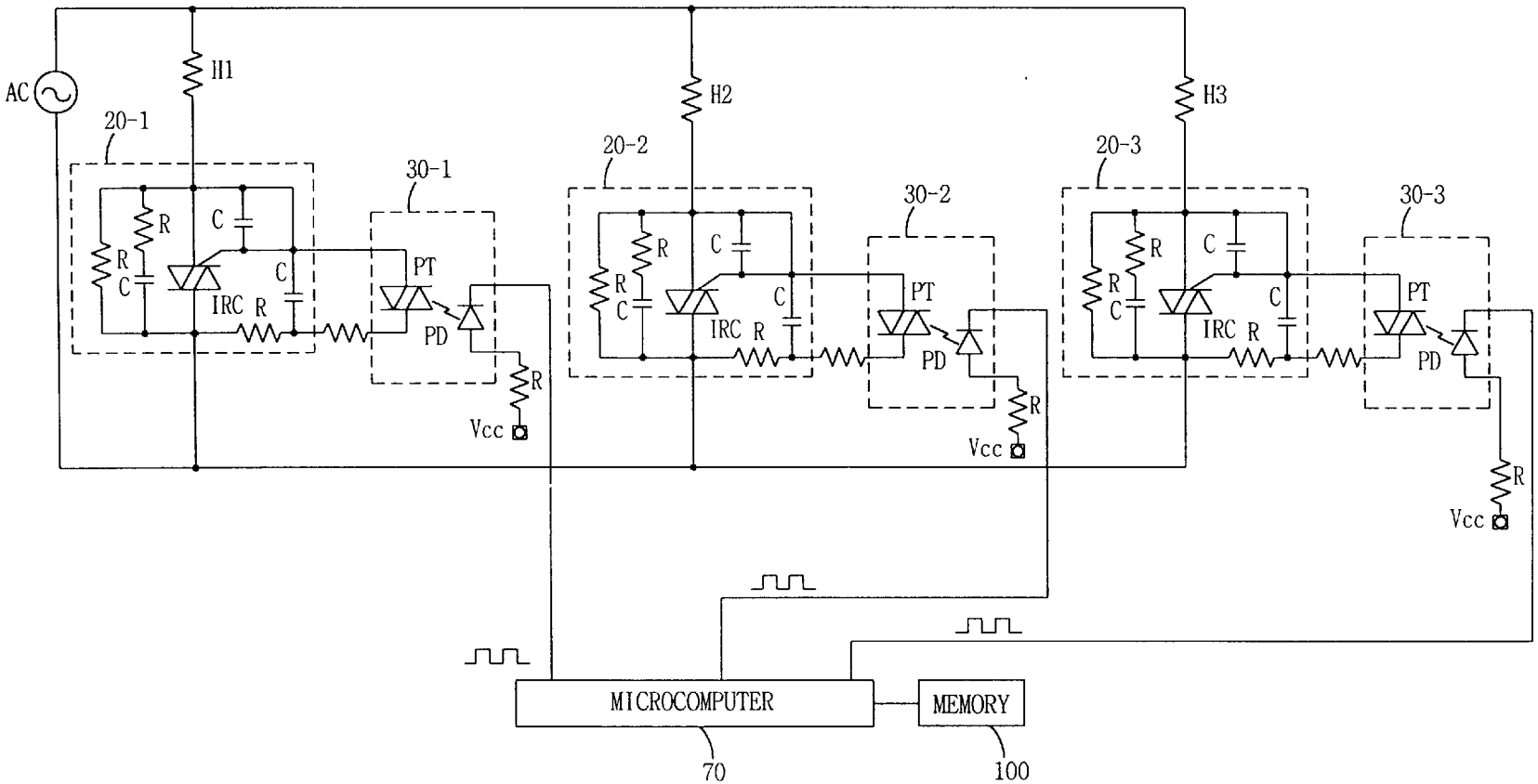
FIG. 3 is a circuit diagram of the preferred embodiment of the halogen heater control apparatus of the microwave oven of the present invention.

FIG. 3 is a circuit diagram of the conventional halogen heater control apparatus of the microwave oven, it comprises a memory 100 which stores infrared wavelength patterns corresponding to characters of foodstuff and data in relation to the foodstuff, a microcomputer 70 which receives the data regarding the dish from the memory 100 and outputs a heater output variable control signal corresponding to the data when a halogen heater output mode is selected by a user. A first, a second and a third signal transmission unit 30-1, 30-2, 30-3 transmits the heater output variable control signal of the microcomputer 70. A first, a second and a third halogen heater switching unit 20-1, 20-2, 20-3 operate the heater output variable control signal inputted to the first, second and third signal transmission unit 30-1, 30-2, 30-3 and alters/controls the infrared wavelength outputted from halogen heater units H1, H2, H3. The first, second and third halogen heater unit H1, H2, H3 output the infrared wavelengths of the halogen heater according to the ON/OFF operation of the switching unit 20-1, 20-2, 20-3.

The operation of the preferred embodiment of the present invention will be described with the first halogen heater as an example.

First, the foodstuff data is stored in the memory 100 by the user, when a magnetron output mode is selected as the microwave output mode by the user, the foodstuff is cooked by the microwaves of the conventional microwave oven, when the halogen heater output mode is selected, the microcomputer 70 is inputted the foodstuff data from the memory 100 and outputs the heater output variable control signals corresponding to the foodstuff data.

According to this, the first signal transmission unit 30-1 connected to the microcomputer 70 is inputted the heater output variable control signal and applies it to the first halogen heater switching unit 20-1.

Herein, the first signal transmission unit 30-1 includes a light emitting diode PD turned on by the heater output variable control signal and a photocoupler PC having phototriac PT controlled by a light signal of the light emitting diode PD, when the heater output variable control signal is outputted as a low potential, the light emitting diode PD and the phototriac PT are turned on.

After that, the triac of the first halogen heater switching unit 20-1 is applied the electricity inputted through the first signal transmission unit 30-1 at a gate, and alters/controls the infrared wavelengths from the first halogen heater H1 by regulating the utility AC power source to the first halogen heater H1.

Herein, the triac of the halogen heater switching unit 20-1 is parallel-connected to a plurality of resistors R and capacitors C, it can prevent Surge Noise which is generated in frequent ON/OFF operation of the triac TRC.

Figure 4:
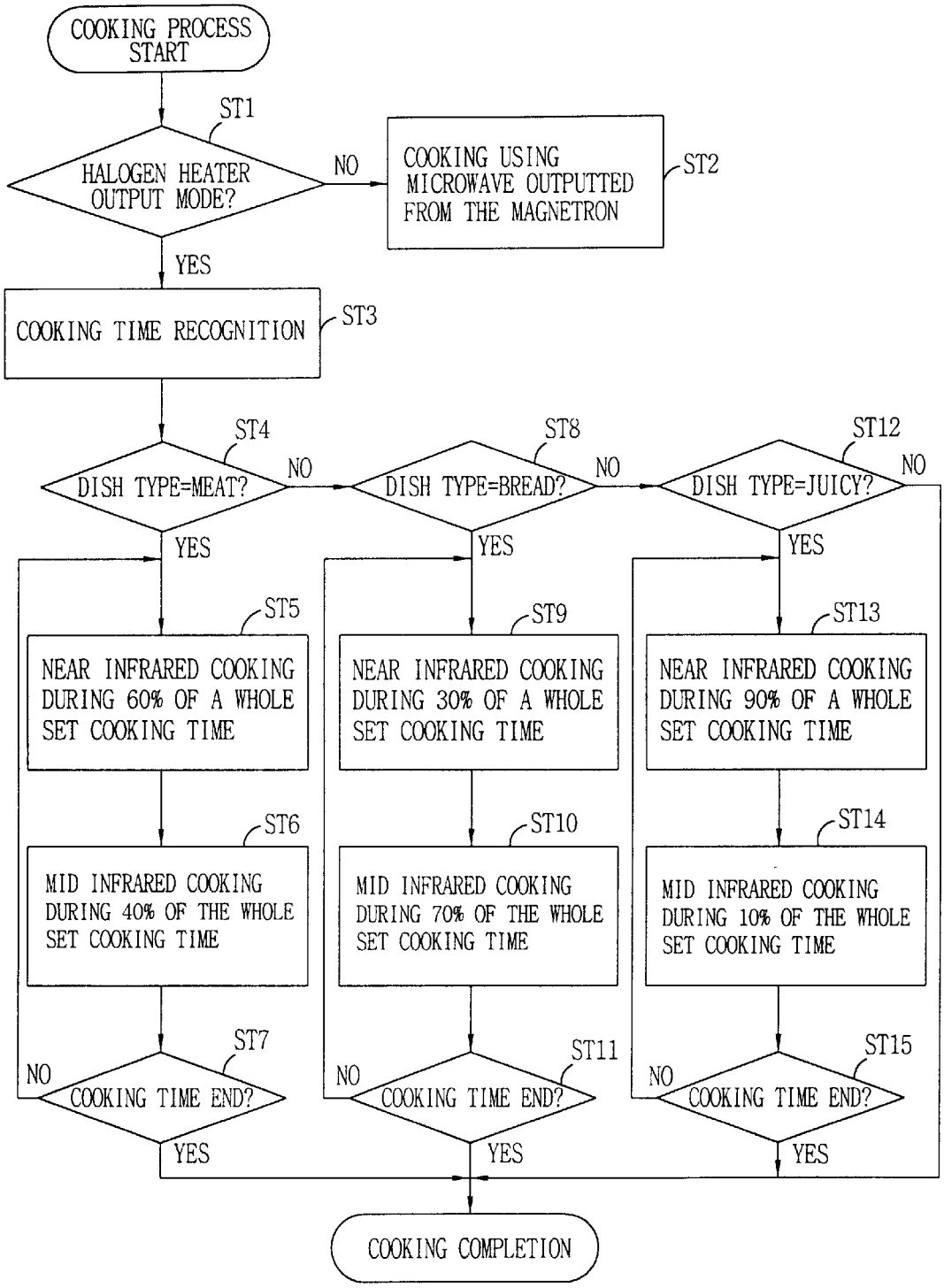
FIG. 4 is a flow chart of the preferred embodiment of the halogen heater control method of the present invention.

FIG. 4 is a flow chart of the halogen heater control method of the microwave oven of the present invention. The control apparatus of the microwave oven judges whether the selected mode is the halogen heater output mode ST1, when the selected mode is confirmed as the magnetron output mode, cooking is performed by using the microwave from the magnetron ST2. When the halogen heater output mode is confirmed, cooking time is recognized at ST3, the infrared wavelength outputted from the halogen heater is altered in accordance with the foodstuff, and the foodstuff is cooked ST4~ST15. The cooking process is altered in accordance with dishes divided into meat type, bread type and juicy type, and the detailed processes will now be described.

The cooking time is recognized at ST3, a dish type is judged at ST4. When the dish is meat, near infrared wave cooking occupies 60% of a whole cooking time ST5, mid infrared wave cooking occupies 40% of the whole cooking time ST6. The cooking time end is judged at ST7, when the cooking time end is confirmed, the microwave oven finishes the cooking process. When the cooking time end is not confirmed, the cooking process is continued in the cooking time ST4.

Meanwhile, when the dish is not meat, the dish is judged as the bread type ST8, the near infrared wave cooking occupies 30% of a whole cooking time ST9, and the mid infrared wave cooking occupies the remaining 70% of the whole cooking time ST10. After that, the cooking time end is judged at ST11, and the cooking time end is confirmed, the microwave oven finishes the cooking process. When the cooking time ends is not confirmed, the cooking process is continued in the cooking time ST9.

In the meantime, when the dish is not bread, the dish is judged as to whether it is the juicy type at ST12, the juicy type is confirmed, the near infrared wavelength cooking occupies 90% of a whole cooking time ST13, the mid infrared wavelength cooking occupies the remaining 10% of the whole cooking time ST14. After that, the cooking time end is judged, and the cooking time end is confirmed, the microwave oven finished the cooking process. When the cooking time end is not confirmed, the cooking process is continued in the cooking time ST13.

Figure 5:
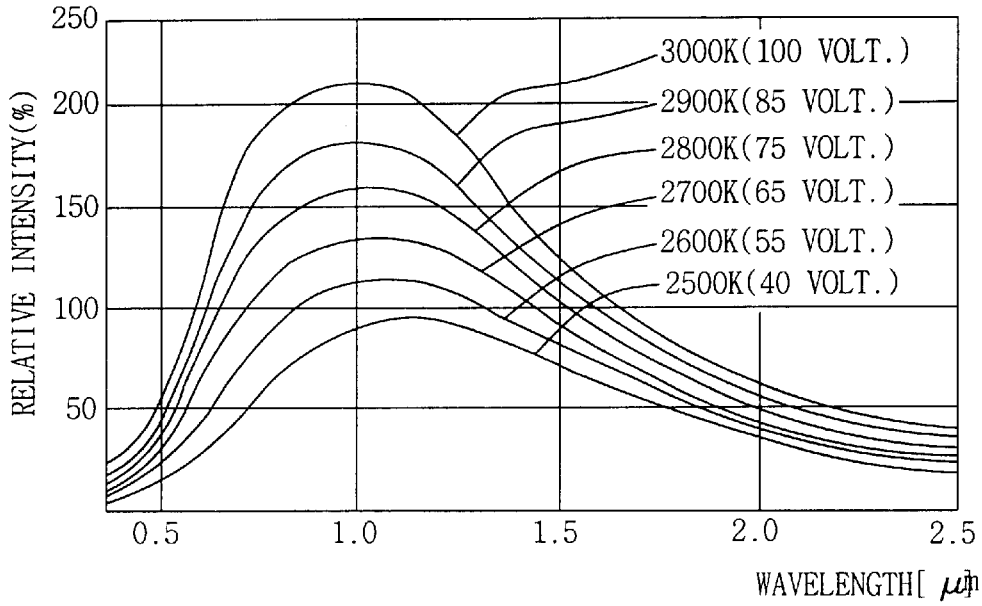
FIG. 5 is a waveform diagram illustrating infrared wavelengths outputted from the halogen heater in accordance with electricity inputted to the halogen heater.

FIG. 5 is a waveform diagram illustrating the infrared wavelengths outputted from the halogen heater H1, H2 H3 according to the electricity inputted to the halogen heater. The heater output variable control signal of the microcomputer 70 is a pulse, when off time takes long, the utility Ac power source duty cycle inputted from the halogen heater unit H1, H2, H3 through the triac TRC increases and high energy infrared wavelength is generated. On the contrary when the off time is short, the utility AC power source duty cycle flowed through the triac TRC decreases and a low energy infrared wavelength is generated. Likewise, the dish can be cooked efficiently by altering the infrared wavelength outputted from the halogen heaters H1, H2, H3.

Figure 6:
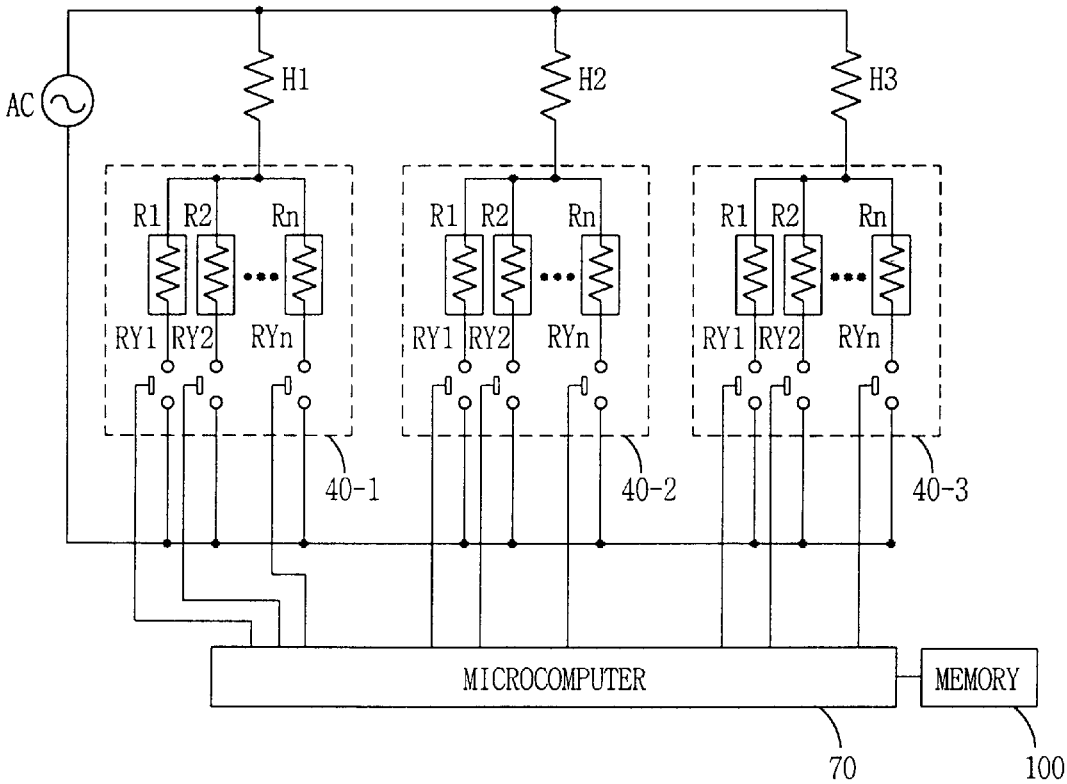
FIG. 6 is a circuit diagram of another preferred embodiment of the halogen heater control apparatus of the microwave oven of the present invention.

FIG. 6 is a circuit diagram of the preferred embodiment of the halogen heater control apparatus of the microwave oven of the present invention. It comprises the memory 100 which stores the patterns of infrared wavelengths and dish data. The microcomputer 70 outputs the heater output variable control signal corresponding to the dish type when the halogen heater output mode is selected. A first, a second and a third halogen heater switching unit 40-1, 40-2, 40-3 alter and control the infrared wavelength outputted from the halogen heater unit H1, H2, H3 in accordance with the heater output variable control signal of the microcomputer 70, and the first, second and third halogen heater unit H1, H2, H3 generate various infrared wavelengths in accordance with the resistance value of the switching unit, which controls the duty cycle.

Herein, the halogen heater switching unit 40-1, 40-2, 40-3 separately includes a plurality of power relays RY1~Ryn which are ON/OFF in accordance with the heater output variable control signal as a square wave and a plurality of resistors R1~Rn which are separately series-connected to the plurality of the power relays RY1~Ryn correspondingly, and alters/controls the infrared wavelengths outputted from the halogen heater unit H1, H2, H3 by controlling the electric voltage duty cycle applied to the halogen heater units H1, H2, H3.

Herein, the heater output variable control signals of the microcomputer 70 generate high infrared wavelengths corresponding to on-time pulse increases. On the contrary, it generates low infrared wavelengths corresponding to the on-time pulse decreases, namely, duty cycle changes.

The preferred embodiment of the present invention alters the infrared wavelengths outputted from the halogen heater units H1, H2, H3 by controlling the utility AC power source duty cycle applied to the halogen heater units H1, H2, H3. Accordingly it cooks the foodstuff by using the infrared wavelengths proper for a given foodstuff.

As described above, the present invention is capable of optimum heating and cooking of various kinds of foodstuff by selectively altering and controlling the infrared wavelengths generated from the halogen heater.

As the present invention may be embodied in several forms without departing from the spirit or essential characteristics thereof, it should also be understood that the above-described embodiments are not limited by any of the details of the foregoing description, unless otherwise specified, but rather should is be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A halogen heater control apparatus of a microwave oven, comprising:

a plurality of halogen heater units connected to a utility AC power source;

a halogen heater switching unit connected to the utility AC power source and the halogen heater units; and a microcomputer which controls operation of the halogen switching unit to selectively and incrementally alter the infrared wavelengths output from the respective halogen heater units.

2. The halogen heater control apparatus of the microwave oven according to claim 1, wherein the halogen heater switching unit includes an electrical switching element which receives a heater output variable control signal from the microcomputer and controls a duty cycle of the utility AC power source inputted to the respective halogen heaters.

3. The halogen heater control apparatus of the microwave oven according to claim 2, wherein the electrical switching element is a triac.

4. The halogen heater control apparatus of a microwave oven according to claim 2, wherein the halogen heater switching unit comprises a signal transmission unit which transmits the heater output variable control signal from the microcomputer to the electrical switching element.

5. The halogen heater control apparatus of the microwave oven according to claim 4, wherein the signal transmission unit is an isolator such as a photocoupler including a phototriac which operates in accordance with the heater output variable control signal of the microcomputer.

6. The halogen heater control apparatus of the microwave oven according to claim 1, wherein the microcomputer further comprises a memory which stores data about foodstuff to be cooked and infrared output wavelengths of the halogen heater according to characteristics of the foodstuff.

7. The halogen heater control apparatus of the microwave oven according to claim 1, wherein the halogen heater switching unit includes a plurality of power relays which are ON/OFF in accordance with the heater output variable control signal, and a plurality of resistors which are separately series-connected to the plurality of the power relays correspondingly.

8. The halogen heater control apparatus of the microwave oven according to claim 7, wherein the halogen heater switching unit incrementally alters the infrared output wavelength from the halogen heater by altering the electric voltage applied to the halogen heater unit in accordance with the heater output variable control signal.

9. A halogen heater control method for a combined microwave and halogen heater oven, comprising the steps of:

judging a microwave oven output mode selected by a user as to whether it is a halogen heater output mode;

recognizing cooking time and dish type of a foodstuff when the halogen heater output mode is confirmed;

altering infrared wavelengths outputted from the halogen heater according to a recognition result; and cooking the foodstuff.

10. The halogen heater control method of the microwave oven according to claim 9, wherein the cooking process includes the steps of:

(a) cooking the foodstuff by using near infrared wavelength during set cooking times in accordance with an infrared output wavelength stored in a memory; and (b) cooking the foodstuff by using mid infrared wavelengths during a remaining set cooking time.

11. The halogen heater control method of the microwave oven according to claim 10, wherein the infrared output program for a meat type foodstuff performs the near infrared wave cooking during 60% of a whole set cooking time, and after that performs the mid infrared wave cooking during the remaining 40% of the set cooking time.

12. The halogen heater control method of the microwave oven according to claim 10, wherein a infrared output program for bread type foodstuff performs the near infrared wave cooking during 30% of a whole set cooking time, and after that performs the mid infrared wave cooking during the remaining 70% of the set cooking time.

13. The halogen heater control method of the microwave oven according to claim 10, wherein an infrared output program for juicy type cooking performs the near infrared wave cooking during 90% of a whole set cooking time, and after that performs the mid infrared wave cooking during the remaining 10% of the set cooking time.

* * * * *